US009368104B2

(12) United States Patent
Eller et al.

(10) Patent No.: US 9,368,104 B2
(45) Date of Patent: Jun. 14, 2016

(54) SYSTEM AND METHOD FOR SYNTHESIZING HUMAN SPEECH USING MULTIPLE SPEAKERS AND CONTEXT

(71) Applicant: SRC, Inc., North Syracuse, NY (US)

(72) Inventors: David Donald Eller, Canastota, NY (US); Steven Brian Morphet, Camillus, NY (US); Watson Brent Boyett, Syracuse, NY (US)

(73) Assignee: SRC, INC., North Syracuse, NY (US)

( * ) Notice: Subject to any disclaimer, the term of this patent is extended or adjusted under 35 U.S.C. 154(b) by 445 days.

(21) Appl. No.: 13/835,315

(22) Filed: Mar. 15, 2013

(65) Prior Publication Data

US 2013/0289998 A1 Oct. 31, 2013

Related U.S. Application Data

(60) Provisional application No. 61/640,289, filed on Apr. 30, 2012.

(51) Int. Cl.
*G10L 13/00* (2006.01)
*G10L 13/08* (2013.01)

(52) U.S. Cl.
CPC ..... *G10L 13/08* (2013.01)

(58) Field of Classification Search
CPC ..... G10L 13/00; G10L 13/047
USPC ..... 704/258, 260, 266
See application file for complete search history.

(56) References Cited

U.S. PATENT DOCUMENTS

| | | | | |
|---|---|---|---|---|
| 4,214,125 | A * | 7/1980 | Mozer et al. | 704/268 |
| 5,387,239 | A | 2/1995 | Bianco et al. | |
| 5,850,629 | A * | 12/1998 | Holm | G06F 3/16 704/260 |
| 5,890,117 | A * | 3/1999 | Silverman | 704/260 |
| 6,308,156 | B1 | 10/2001 | Barry et al. | |
| 6,496,801 | B1 | 12/2002 | Veprek et al. | |
| 6,826,530 | B1 * | 11/2004 | Kasai et al. | 704/258 |
| 6,847,931 | B2 | 1/2005 | Addison et al. | |
| 7,047,194 | B1 * | 5/2006 | Buskies | 704/258 |
| 7,567,896 | B2 | 7/2009 | Coorman et al. | |
| 7,668,717 | B2 | 2/2010 | Mizutani et al. | |
| 7,953,600 | B2 | 5/2011 | Hertz et al. | |
| 8,027,837 | B2 | 9/2011 | Silverman et al. | |
| 8,036,894 | B2 | 10/2011 | Neeracher et al. | |
| 8,195,464 | B2 | 6/2012 | Morita et al. | |

(Continued)

FOREIGN PATENT DOCUMENTS

| | | |
|---|---|---|
| JP | 2009251199 | 10/2009 |
| KR | 20100072962 | 7/2010 |
| WO | 0115138 | 1/2001 |

OTHER PUBLICATIONS

International Search Report Form PCT/ISA/210, International Application No. PCT/US2013/038736, pp. 1-3, Dated.

(Continued)

*Primary Examiner* — Michael N Opsasnick
(74) *Attorney, Agent, or Firm* — Bond Schoeneck & King, PLLC; Blaine Bettinger; George McGuire

(57) ABSTRACT

A system and method for realistic speech synthesis which converts text into synthetic human speech with qualities appropriate to the context such as the language and dialect of the speaker, as well as expanding a speaker's phonetic inventory to produce more natural sounding speech.

31 Claims, 6 Drawing Sheets

(56) References Cited

U.S. PATENT DOCUMENTS

| | | | | |
|---|---|---|---|---|
| 2003/0139818 | A1 | 7/2003 | Rogers et al. | |
| 2003/0158734 | A1 | 8/2003 | Cruickshank | |
| 2003/0212555 | A1* | 11/2003 | van Santen | 704/241 |
| 2005/0182629 | A1* | 8/2005 | Coorman et al. | 704/266 |
| 2006/0041429 | A1* | 2/2006 | Amato | G10L 13/08 704/260 |
| 2006/0122600 | A1 | 6/2006 | Cole | |
| 2006/0229877 | A1 | 10/2006 | Tian et al. | |
| 2006/0259303 | A1* | 11/2006 | Bakis | 704/268 |
| 2006/0287861 | A1* | 12/2006 | Fischer et al. | 704/260 |
| 2008/0177334 | A1 | 7/2008 | Stinnette | |
| 2008/0221894 | A1 | 9/2008 | Moehler et al. | |
| 2009/0144053 | A1 | 6/2009 | Tamura et al. | |
| 2009/0300041 | A1 | 12/2009 | Schroeter | |
| 2010/0211393 | A1 | 8/2010 | Kato et al. | |
| 2011/0230883 | A1 | 9/2011 | Zahrly et al. | |
| 2012/0072224 | A1 | 3/2012 | Khitrov | |

OTHER PUBLICATIONS

International Search Report Form PCT/ISA/220, International Application No. PCT/US2013/043900, pp. 1-14, dated Aug. 26, 2013.

Kain et al. "Unit-Selection Text-to-Speech Synthesis Using an Asynchronous Interpolation Model". Proceedings of 6th ISCA Workshop on Speech Synthesis [Online] 2007, pp. 1-6.

Malcangi et al. "Toward Language-independent Text-to-speech Synthesis". WSEAS Transactions on Information Science and Applications [Online] 2010, vol. 7, Issue 3, pp. 411-421.

Rashad et al. "An Overview of Text-To-Speech Synthesis Techniques". CIT'10 Proceedings of the 4th international conference on Communications and information technology [Online] 2010, pp. 84-89.

Segi et al. "A Concatenative Speech Synthesis Method Using Context Dependent Phoneme Sequences With Variable Length as Search Units". 5th ISCA Speech Synthesis Workshop [Online] 2003, pp. 115-120.

* cited by examiner

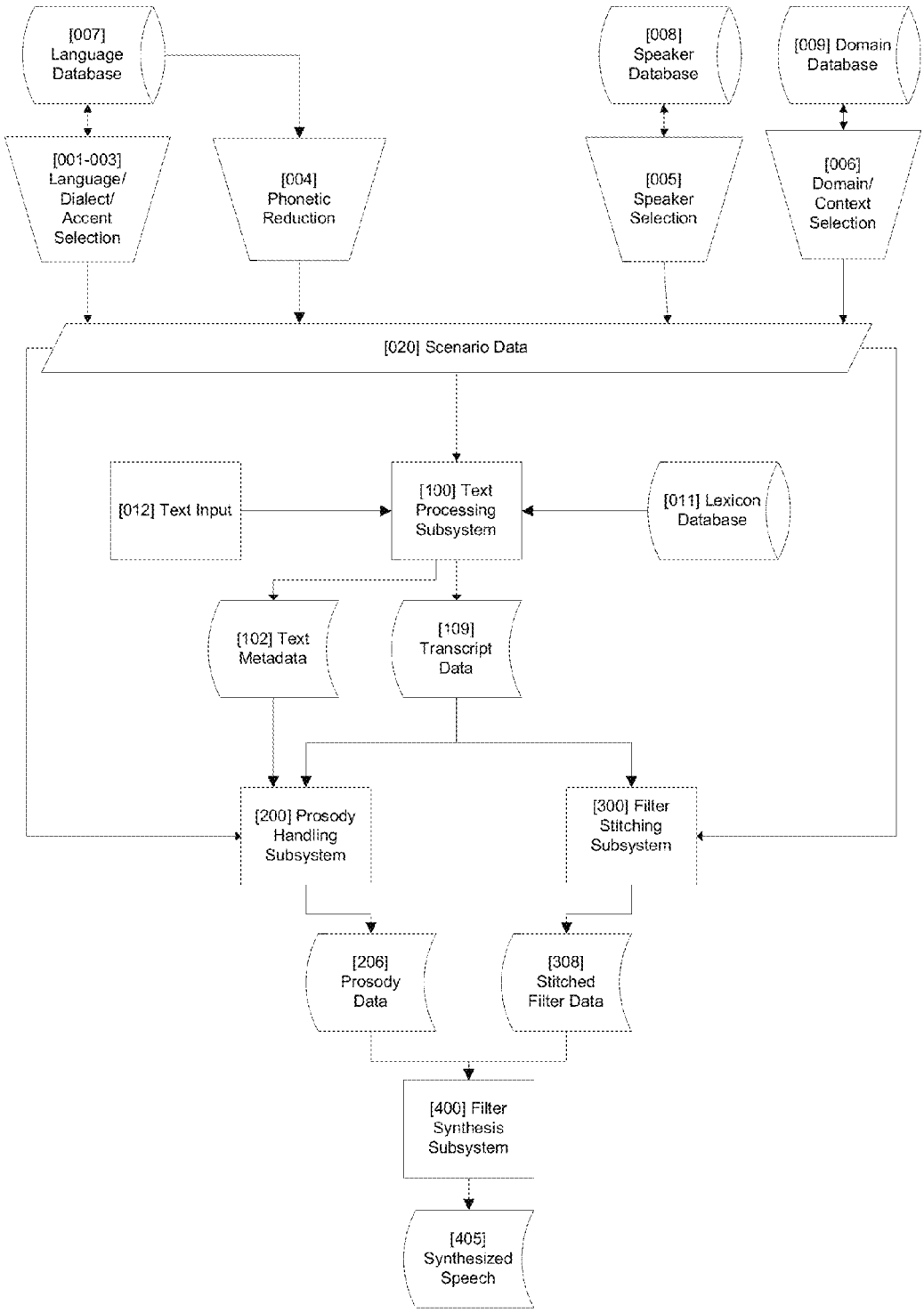
Figure 1 – System Overview

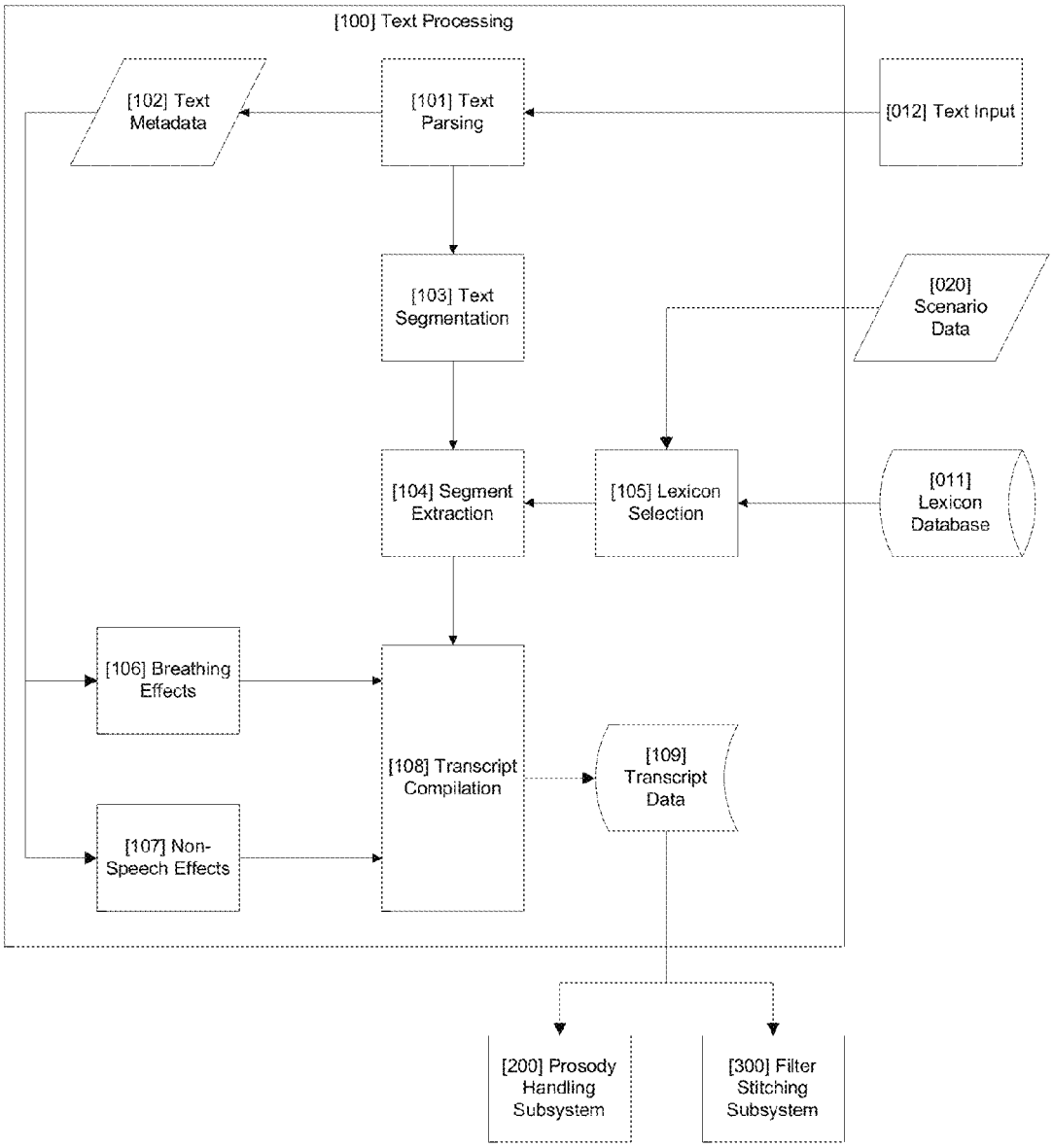
Figure 2 – Text Processing Subsytem

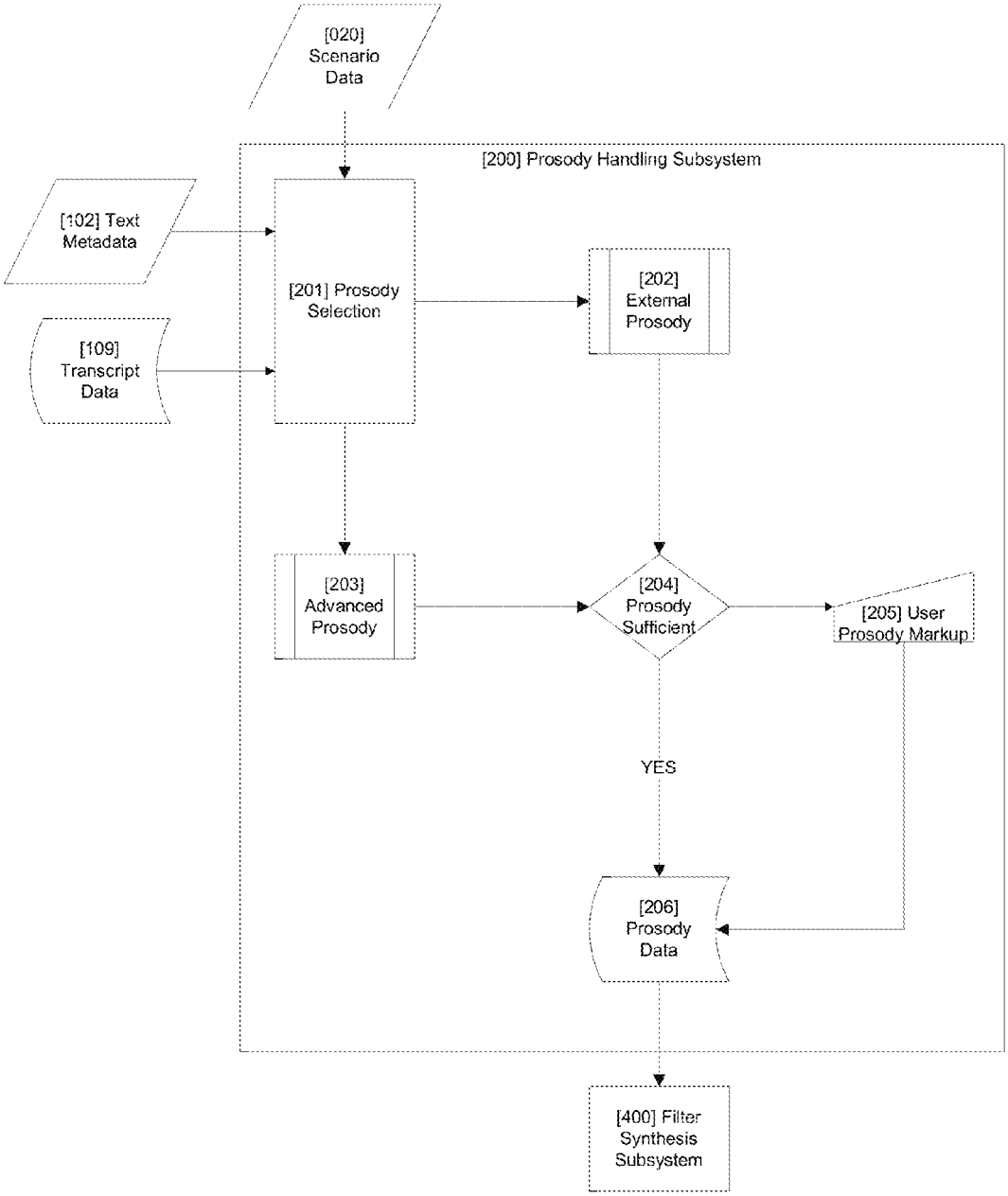
Figure 3 – Prosody Handling Subsystem

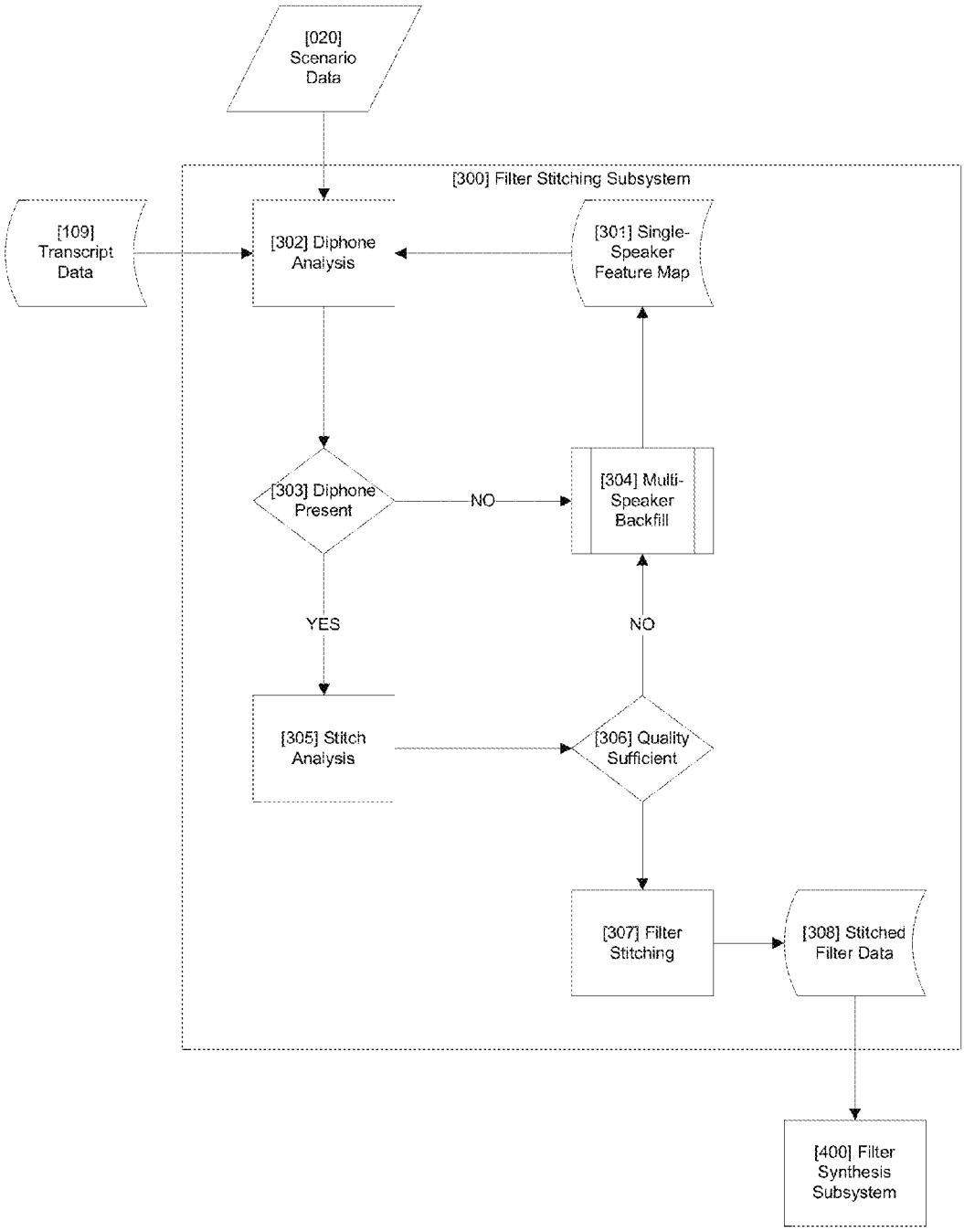
Figure 4 – Filter Stitching Subsystem

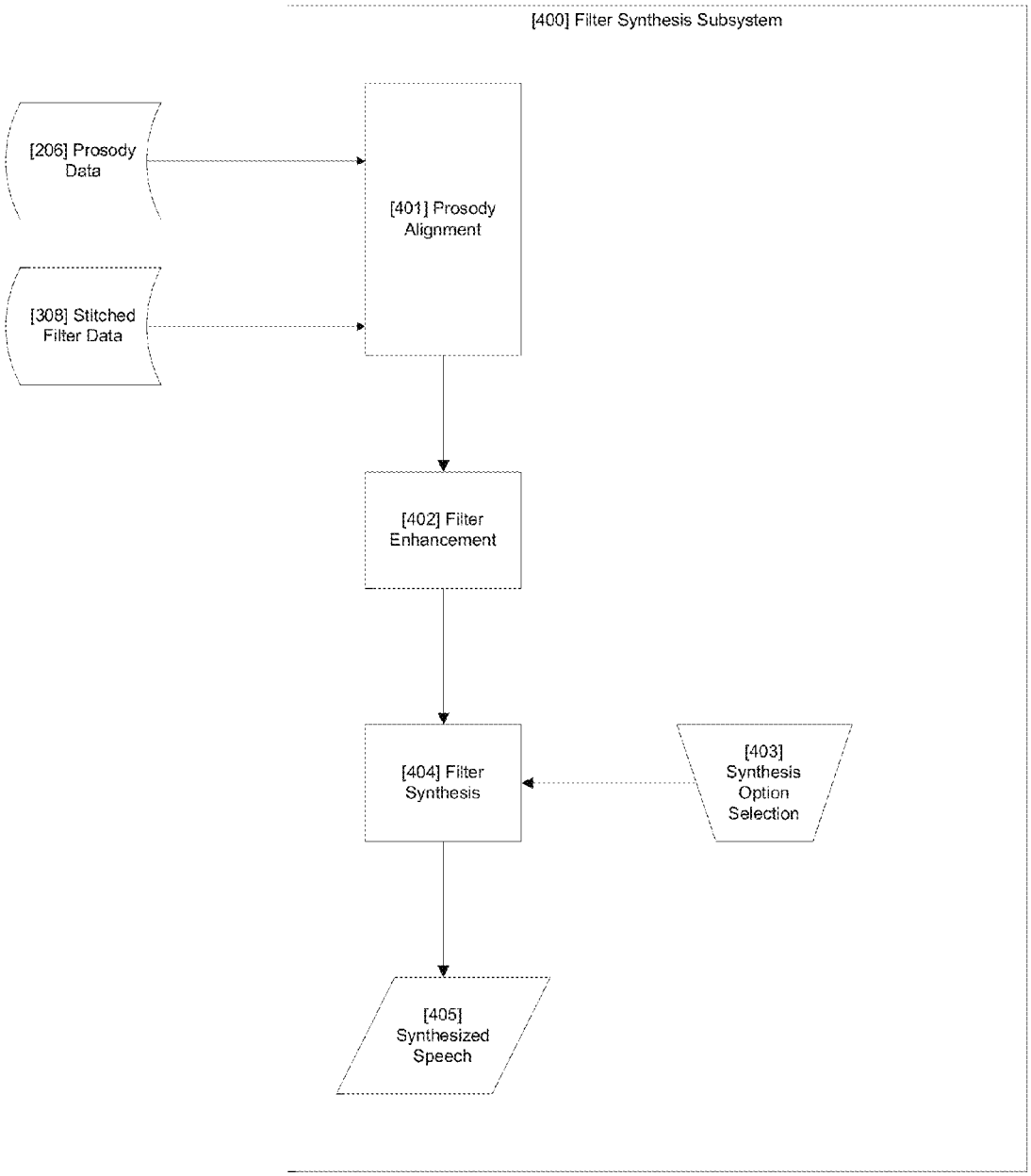
Figure 5 – Filter Synthesis Subsystem

SYSTEM AND METHOD FOR SYNTHESIZING HUMAN SPEECH USING MULTIPLE SPEAKERS AND CONTEXT

REFERENCE TO RELATED APPLICATION

This application claims priority to U.S. Provisional Patent Application Ser. No. 61/640,289, filed on Apr. 30, 2012 and entitled "Speech Synthesis System" the entire disclosure of which is incorporated herein by reference.

BACKGROUND

1. Field of Invention

The present invention generally relates to speech synthesis systems, and more particularly to a speech synthesis system that produces a natural sounding synthesized speech from text and contextual input.

2. Background of Art

There is an increasing need for speech synthesis systems that resemble realistic human speech. For example, realistic synthetic speech is needed wherever state of the art text to speech technologies are applied, such as in automated voice systems, navigation devices and e-mail readers. These systems are also particularly helpful for the disabled, and can provide a person's only means to verbally communicate or receive electronic information. While current synthetic speech systems exist, these systems suffer from degrees of unacceptable speech quality and are insufficient for producing speech for long text passages or in other applications such as computer-based training modules, linguist training materials, or entertainment industry uses, such as cartoons. Accordingly, there is a need for more realistic, natural-sounding synthesized speech.

Current speech synthesis technologies that attempt to make a speaker sound more natural, or to be able to speak in another language or dialect, are largely limited to morphing or transform effects on the existing sample. These attempts to modify an already existing sample are ineffective to accurately replicate natural-sounding synthesized speech. A need exists in the art to input both text and contextual data, to convert the text into synthetic human speech with qualities appropriate to the context, such as the language and dialect of the speaker.

Further, current speech systems often rely on the stored speech inventory of a single speaker to produce speech that is more realistic and resembles that speaker. These systems are constrained by the speaker's limited speech inventory, and are insufficient for reproducing natural sounding speech when the speech inventory does not contain all the necessary phonetic elements to synthesize a given text. Further, even when speech inventories do have the necessary phonetic elements to synthesize a given text, the features of a given phonetic element, such as the frequency, bandwidth, or amplitude, often do not match the features of the following phonetic element, resulting in poor quality synthesized speech. A need therefore exists in the art to expand a speaker's speech inventory so the system has the resources to synthesize speech from any given text in a realistic, natural-sounding way.

For the foregoing reasons, there is a need for more realistic synthetic speech systems.

SUMMARY

The present invention is directed to an apparatus that satisfies this need for a more realistic synthetic speech system.

It is a principal object and advantage of the present invention to provide a speech synthesis system that fuses speech and non-speech feature data.

It is another object and advantage of the present invention to provide a speech synthesis system that backfills a speaker's phonetic inventory with available data from other speakers in a manner emulating the sound of the desired speaker.

It is a further object and advantage of the present invention to provide a speech synthesis system that uses available backfilled speaker inventory with phonemes and transitions from any other speaker or language trained to the system.

It is an additional object and advantage of the present invention to provide a speech synthesis system that extends a speaker's speech inventory to cover foreign languages and dialect sounds sampled in a foreign or accented speaker.

It is yet another object and advantage of the present invention to provide a speech synthesis system for automatically, selectively choosing a phoneme transition from a group of potential transitions.

It is still a further object and advantage of the present invention to provide a speech synthesis system automatically selecting and applying a domain/context dependant prosody parameter that permits a user to custom tailor the synthetic speech to predetermined scenarios and applications.

It is an additional object and advantage of the present invention to provide a speech synthesis system that stitches and blends features of one phoneme with those of the following phoneme.

Other objects and advantages of the present invention will in part be obvious, and in part appear hereinafter.

In accordance with the foregoing objects and advantages, a method of synthesizing speech from text, comprising the steps of: (i) selecting one or more scenario parameters; (ii) inputting text parsed into corresponding phonetic components; (iii) merging the phonetic components with breathing and non-speech effects to produce a transcript of phoneme segment strings; (iv) producing prosody contour data from the one or more scenario parameters and the transcript of phoneme segment strings; (v) producing stitched filter data from the one or more scenario parameters and the transcript of phoneme segment strings; (vi) synthesizing speech from the stitched filter data and the prosody contour data; and (vii) outputting the synthesized speech from a playback device.

According to another aspect, the one or more scenario parameters are selected from the group consisting of language, dialect, accent, phonetic reduction, domain, context, and a single speaker.

According to another aspect, the one or more scenario parameters are selected by a user.

According to an aspect, a user provides the prosody contour.

According to an aspect, producing the stitched filter data comprises: (i) receiving the text parsed into corresponding phonetic components; (ii) matching each corresponding phonetic component with a corresponding signal feature candidate; (iii) identifying within the corresponding signal feature candidates each pair of adjacent signal feature candidates; (iv) modifying the formant features of each phonetic component within the pair of adjacent signal feature candidates such the first candidate within the pair transitions smoothly to the second phonetic candidate within the pair.

According to an aspect, a method for synthesizing speech from text, comprising the steps of: (i) providing a computer having a first database and a second database stored in the memory thereof and in which data is stored, the data in the first database representing a set of signal feature candidates representative of a single speaker, and the data in the second database representing a second set of signal feature candidates; (ii) receiving a target set of phonetic components representative of text; (iii) analyzing the single speaker signal feature candidates from the first database to determine whether a corresponding single speaker signal feature candidate exists for each target phonetic component; (iv) retrieving from the second database a replacement signal feature candidate from the second set of signal feature candidates for any target phonetic component that does not have a corresponding single speaker signal feature candidate; (v) synthesizing speech from at least one of the corresponding single signal feature candidates and the replacement signal feature candidates.

According to an aspect, the method further comprises the step of modifying the replacement signal feature candidates such that the synthesized speech from the replacement signal feature candidates resembles the synthesized speech of the single speaker signal feature candidates.

According to an aspect, the method of modifying comprises the steps of: (i) constructing a map of the single speaker signal feature candidates and corresponding signal feature candidates from the second set of signal feature candidates; (ii) training a system on the map capable of generalizing difference between the single speaker signal feature candidates and corresponding signal feature candidates from the second stored set of signal feature candidates; (iii) modifying the replacement phonetic component according to generalized difference represented in the system.

According to an aspect, the single speaker signal feature candidates and the replacement components are signal feature candidates representing diphones, each candidate from the single speaker signal feature candidates and the replacement components have a first steady-state portion, a transition portion, and a second steady-state portion.

According to an aspect, the method of modifying comprises: (i) identifying the transition portion of the replacement diphones and the single speaker candidate; (ii) training a system on the transition portion, capable of generalizing features of the transition portion; (iii) generating a new transition portion according the system; (iv) replacing the transition portion of the first steady-portion with the new transition portion.

According to an aspect, a method for synthesizing speech from text, comprising the steps of: (i) providing a computer having a first database and a second database stored in the memory thereof and in which data is stored, the data in the first database representing a set of signal feature candidates representative of a single speaker, and the data in the second database representing a second set of signal feature candidates; (ii) receiving a target set of phonetic components representative of text; (iii) analyzing the single speaker signal feature candidates from the first database to determine whether a corresponding single speaker signal feature candidate of sufficient quality exists for each target phonetic component; (iv) retrieving from the second database a replacement signal feature candidate from the second set of signal feature candidates for any target phonetic component that does not have a corresponding single speaker signal feature candidate of sufficient quality; and (v) synthesizing speech from at least one of the corresponding single speaker signal feature candidates and the replacement signal feature candidates.

According to an aspect, sufficient quality is determined by: (i) receiving the single speaker signal feature candidates; (ii) identifying within the corresponding signal feature candidates each pair of adjacent signal feature candidate; (iii) measuring the cost of joining each the pair of adjacent signal feature candidates; and (iv) determining whether the cost is too high.

According to an aspect, the method further comprising the step of: modifying the replacement signal feature candidates such that the resulting synthesized speech from the replacement signal feature candidates resembles the resulting synthesized speech of the single speaker signal feature candidates.

According to an aspect, modifying further comprises: (i) constructing a map of the single speaker signal feature candidates and corresponding signal feature candidates from the second set of signal feature candidates; (ii) training a system on the map capable of generalizing difference between the single speaker signal feature candidates and corresponding signal feature candidates from the second set of signal feature candidates; modifying the replacement signal feature candidate according to generalized difference represented in the system.

According to an aspect, single speaker signal feature candidates and the replacement components are signal feature candidates representing diphones; each candidate from the single speaker phonetic components and the replacement components having a first steady-state portion, a transition portion, and a second steady-state portion.

According to an aspect, modifying further comprises: (i) identifying the transition portion of the replacement diphones and the single speaker feature candidate diphones; (ii) training a system on the transition portion, capable of generalizing features of the transition portion; (iii) generating a new transition portion according the system; and (iv) replacing the transition portion of the first steady-portion with the new transition portion.

According to another aspect, a non-transitory computer-readable storage medium containing program code comprising: (i) program code for selecting one or more scenario parameters; (ii) program code for inputting text parsed into corresponding phonetic components; (iii) program code for merging the phonetic components with breathing and non-speech effects to produce a transcript of phoneme segment strings; (iv) program code for producing prosody contour data from the one or more scenario parameters and the transcript of phoneme segment strings; (v) program code for producing stitched filter data from the one or more scenario parameters and the transcript of phoneme segment strings; (vi) program code for synthesizing speech from the stitched filter data and the prosody contour data; program code for outputting the synthesized speech from a playback device.

According to an aspect, the one or more scenario parameters are selected from the group consisting of language, dialect, accent, phonetic reduction, domain, context, and a single speaker.

According to an aspect, the one or more scenario parameters are selected by a user.

According to an aspect, the user provides the prosody contour.

According to an aspect, the storage medium producing the stitched filter data further comprises: (i) program code for receiving the text parsed into corresponding phonetic components; (ii) program code for matching each phonetic component with a corresponding signal feature candidate; (iii) program code for identifying within the corresponding signal feature candidates each pair of adjacent signal feature candidates; (iv) program code for modifying the formant features of each signal feature candidate within the pair of adjacent signal feature candidates such the first phonetic component within the pair transitions smoothly to the second phonetic component within the pair.

According to an aspect, a non-transitory computer-readable storage medium containing program code, comprising (i) program code for receiving a target set of phonetic components representative of text; (ii) program code for analyzing a single speaker's signal feature candidates, the single speaker's signal feature candidates stored in a database, to determine whether a corresponding single speaker signal feature candidate exists for each the target phonetic component; (iii) program code for retrieving from a second set of signal feature candidates, the second set of signal feature candidates stored in database, a replacement signal feature candidate for any target phonetic component that does not have a corresponding single speaker signal feature candidate; (iv) program code for synthesizing speech from at least one of the corresponding single speaker signal feature candidates and the replacement signal feature candidates.

According to an aspect, the storage medium further comprising program code for modifying the replacement signal feature candidates such that the synthesized speech from the replacement signal feature candidates resembles the synthesized speech of the single speaker signal feature candidates.

According to an aspect, the storage medium further comprising program code for modifying comprises: (i) program code for constructing a map of the single speaker signal feature candidates and corresponding signal feature candidates from the second set of signal feature candidates; (ii) program code for training a system on the map capable of generalizing difference between the single speaker signal feature candidates and corresponding signal feature candidates from the second stored set of signal feature candidates; (iii) program code for modifying the replacement signal feature candidate according to generalized difference represented in the system.

According to an aspect, the single speaker signal feature candidates and the replacement components are signal feature candidate representing diphones, each candidate from the single speaker signal feature candidates and the replacement components having a first steady-state portion, a transition portion, and a second steady-state portion.

According to an aspect, program code for modifying comprises: (i) program code for identifying the transition portion of the replacement candidates and the single speaker candidate; (ii) program code for training a system on the transition portion, capable of generalizing features of the transition portion; (iii) program code for generating a new transition portion according the system; (iv) program code for replacing the transition portion of the first steady-portion with the new transition portion.

According to another aspect, a non-transitory computer-readable storage medium containing program code, comprising: (i) program code for receiving a target set of phonetic components representative of text; (ii) program code for analyzing a single speaker's signal feature candidates, the single speaker's signal feature candidates stored in a database, to determine whether a corresponding single speaker signal feature candidate of sufficient quality exists for each the target phonetic component; (iii) program code for retrieving from a second set of signal feature candidates, the second set of signal feature candidates stored in database, a replacement signal feature candidate for any target phonetic component that does not have a corresponding single speaker signal feature candidate of sufficient quality; (iv) program code for synthesizing speech from at least one of the corresponding single speaker signal feature candidates and the replacement signal feature candidates.

According to an aspect, sufficient quality is determined by program code comprising: (i) program code for receiving the single speaker signal feature candidates; (ii) program code for identifying within the corresponding signal feature candidates each pair of adjacent signal feature candidates; (iii) program code for measuring the cost of joining each the pair of adjacent signal feature candidates; (iv) and program code for determining whether the cost is too high.

According to an aspect, the storage medium further comprising program code for modifying the replacement signal feature candidates such that the synthesized speech from the replacement signal feature candidates resembles the synthesized speech of the single speaker signal feature candidates.

According to an aspect, program code for modifying further comprises: program code for constructing a map of the single speaker signal feature candidates and corresponding signal feature candidates from the second set of signal feature candidates; program code for training a system on the map capable of generalizing difference between the single speaker signal feature candidates and corresponding signal feature candidates from the second s set of signal feature candidates; program code for modifying the replacement signal feature candidate according to generalized difference represented in the system.

According to an aspect, the single speaker signal feature candidates and the replacement components are diphones; each diphone from the single speaker signal feature candidates and the replacement components having a first steady-state portion, a transition portion, and a second steady-state portion.

According to an aspect, program code for modifying further comprises: (i) program code for identifying the transition portion of the replacement diphones and the single speaker feature candidate diphones; (ii) according to an aspect, program code for training a system on the transition portion, capable of generalizing features of the transition portion; (iii) program code for generating a new transition portion according the system; program code for replacing the transition portion of the first steady-portion with the new transition portion.

BRIEF DESCRIPTION OF THE DRAWINGS

The present invention will be more fully understood and appreciated by reading the following Detailed Description in conjunction with the accompanying drawings, in which:

FIG. 1 is a high level block diagram of an embodiment of the system of the present invention;

FIG. 2 is a block diagram for the text processing associated with an embodiment of the present invention, wherein it is illustrated for fusing scenario data to select the best pronunciation (lexicon) data, while adding in non-speech sounds;

FIG. 3 is a block diagram for prosody handling associated with an embodiment of the present invention, wherein the multiple prosody selection options are illustrated, from direct user input to a semi-automated approach to a fully automated, external prosody assignment system;

FIG. 4 is a block diagram of filter stitching associated with an embodiment of the present invention, wherein creating missing diphones from existing data is illustrated;

FIG. 5 is a block diagram of an embodiment of a filter synthesis subsystem;

DETAILED DESCRIPTION

Figure 6A:
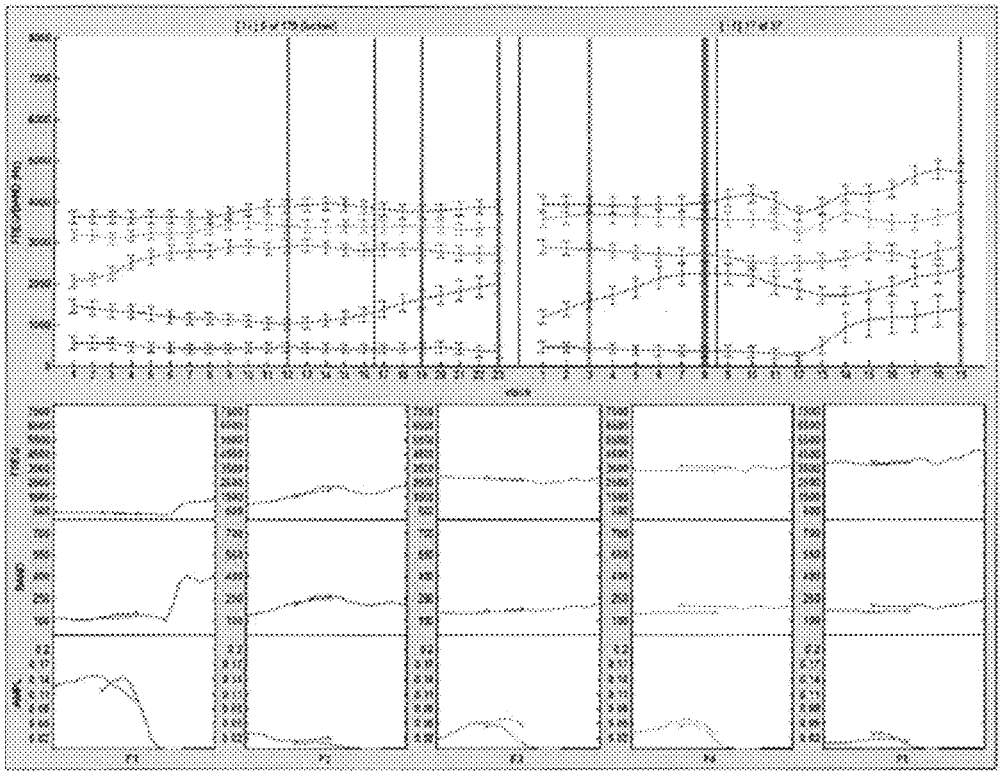
FIG. 6*a* is a graph showing an example of good stitching selection.
Figure 6B:
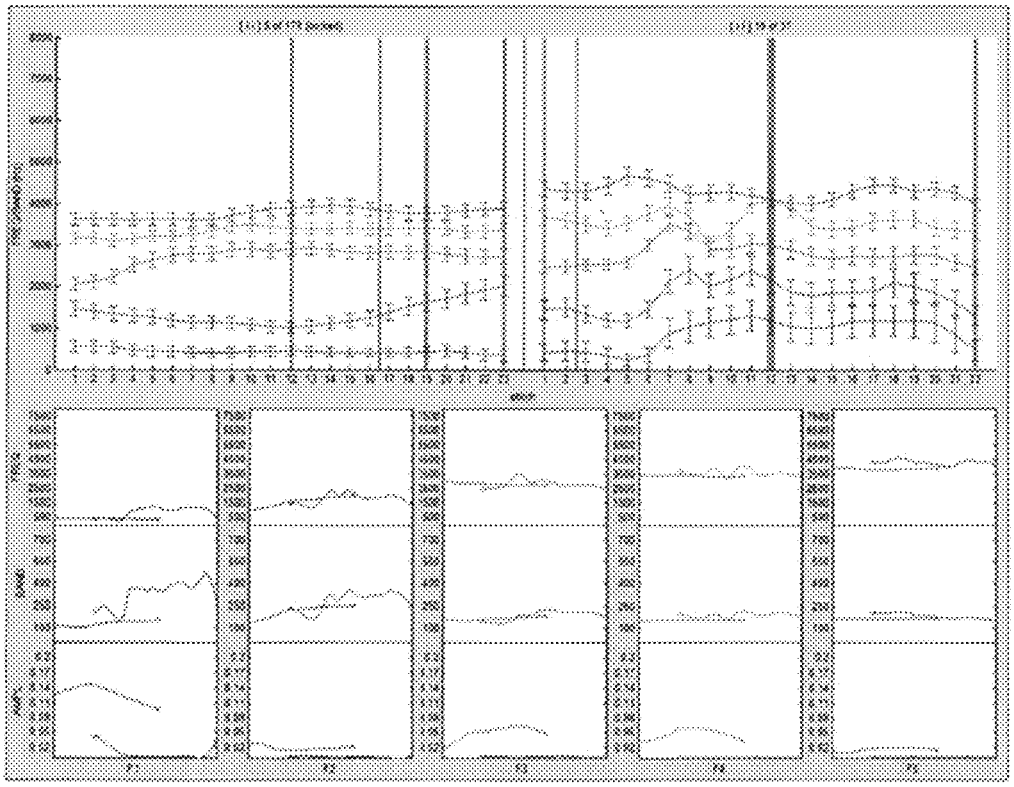
FIG. 6*b* is a graph showing an example of poor stitching selection.

Referring now to the drawings, wherein like reference numerals refer to like parts throughout, FIG. 1 shows an embodiment of the present invention, broadly comprising scenario data 020, a text processing subsystem 100, a prosody handling subsystem 200, a filter stitching subsystem 300, and a filter synthesis subsystem 400.

As a broad overview of the system, scenario data 020 represents the output of a first set of processes, the output containing information the rest of the system requires to produce more natural sounding speech, such as language data, dialect data, speaker data, domain data, and other contextual data, which then serve as the inputs to the remainder of the speech synthesis system. Next, text processing subsystem 100 receives the text input 012, as well as scenario data 020 and transforms text input 012 into data, typically phonemes and diphones, which represents the phonetic composition of text input 012. Prosody handling subsystem 200 receives the output from text processing subsystem 100 as well as scenario data 020 and generates the rhythm, stress, and intonation of the speech. Concurrent with prosody handling subsystem 200, filter stitching subsystem 300 receives the output from text processing subsystem 100 and scenario data 020, and selects the best quality signal features for a given phonetic element to be synthesized. Finally, filter synthesis subsystem 400 receives the output from prosody handling subsystem 200 and filter stitching subsystem 300 and generates a speech waveform.

As stated above, scenario data 020 contains data ancillary to text input 012, required to direct the system in producing more natural sounding speech. This data is supplied to prosody handling subsystem 20, text processing subsystem 100, and filter stitching subsystem 300 to aid those subsystems in selecting appropriate prosody and signal features, respectively. The scenario data can include, but is not limited to, language data, dialect data, accent data, phonetic reduction data, data representative of a single speaker, domain data, and context data. Each relevant data field comprising the scenario data is supplied manually by a user, or through some other automated selection process.

Next, text processing subsystem 100 transforms the text-input into a format that can be used by prosody handling subsystem 200 and filter stitching subsystem 300. It generally does this by parsing the text input into data that represents the phonetic elements, usually phonemes and diphones, denoted by the text. Text processing subsystem 100 also filters out any text metadata, such as italics, and adds breathing effects and any non-speech effects, such as background noise.

Next, prosody handling subsystem 200 uses scenario data 020 and the output from text processing subsystem 100 to generate the necessary prosody for a realistic speech output. Generally speaking, prosody is the rhythm, stress, and intonation of speech. Using the context information supplied by the scenario data 020, prosody handling subsystem 200 manages different combinations of the signal features, duration (rhythm), amplitude (stress), and pitch (intonation and stress), to create the prosodic data appropriate for the context.

Concurrent with prosody handling subsystem 200, filter stitching subsystem 300 uses scenario data 020 and the output from text processing subsystem 100 to select the best quality signal features, such as speech frequency, amplitude, and bandwidth values, for a given phonetic element to be synthesized. The signal features are selected from single-speaker feature map 301 which contains a list of signal features from a given speaker and each signal feature's corresponding phonetic element. If signal features from the single-speaker map are nonexistent or of insufficient quality, the system finds a sample from another speaker, modifies it to match how it would appear if it were from the single-speaker and then adds it to the original speaker's inventory. Through this process, filter stitching subsystem 400 selects best quality signal features for the phonetic elements which are then output from the text processing subsystem 100.

Finally, filter synthesis subsystem 400 generates the synthesized audio output according to the outputs received from prosody Handling Subsystem and the Filter Stitching Subsystem.

Hereinafter, each subsystem is explained in detail.

Scenario Data 020:

Scenario data 020 contains contextual metadata later used by text processing subsystem 100, prosody handling subsystem 200, and filter stitching subsystem 300 to generate more natural sounding speech. The metadata represents the selections of various contextual and language settings, such as the language, dialect and accent of the speaker, or the context in which he or she is speaking. Downstream processes will use these selections in order to properly perform their respective functions. Scenario data 020 in the current embodiment, as shown in FIG. 1, is comprised of metadata supplied by the following processes: language selection 001, dialect selection 002, accent selection 003, phonetic reduction 004, speaker selection 005, and domain/context selection 006, each process, in turn, communicates with, language database 007, speaker database 008, domain database 009.

In the present embodiment, language database 007 is used to store varied linguistic and phonetic information relating to different languages, dialects, accents, and speech patterns. This database represents the known phonotactic parameters for the entire speech synthesis system; however, the database may be expanded through further linguistic analysis.

In various embodiments, database information may include, but is not limited to: list of available languages, indication of whether other than reference dialect and accent data are available, language family, world or country regional associations, map data, text, audio samples, demographic information, one or more lexica for each language, as well as phoneme data, or other data related to the target language. The phoneme data mentioned above may further comprise: phoneme label, alternate phoneme system labels, such as SAMPA, UPSID, ARPABET, IPA, applicable languages, diphone start and stop phonemes, sound type (such as phoneme, phone, segment), manner, articulation 1, voicing, aperture, phoneme type, articulation 2, velarization, nasal feature, lateralization, complex frication, sibilance, aspiration, labialization, length, and supplementary manner.

Language selection 001 process selects the required language to be synthesized from language database 007. In one embodiment, the language is manually selected by the user. In an alternative embodiment, any known language identification technology available in the art may be used. Once the required language has been selected, related data available in one or more databases are also selected and appended, along with language data, to scenario metadata 020 and sent to the text processing subsystem 100. An example of the metadata returned from language selection can be seen in Table 1.

TABLE 1

| Data | Metadata Tag |
|---|---|
| Language = English | <language>Eng</language> |
| Available Dialects | <dialect>NorthAmerican-EasternNewEngland</dialect><br><dialect>NorthAmerican-Midland</dialect> |
| Language Family | <Germanic> |
| Phoneme Data | <phonemeLabel>a</phonemeLabell><xsampalabel>a</xsampalabel><br><manner>vocalic</manner><artic1>prepalatal></artic1><br><voicing>voiced</voicing><aperture>open</aperture><br><phonemeType>vowel</phonemeType><labialization>unrounded</labialization> |

Next, dialect selection 002 further defines pronunciation guides that are unique to a particular dialect of a language. This process is similar in function to language selection 001, but provides additional information to narrow the scope of the desired speaker's lexicon by adding a dialect identifying metadata tag output selection from language database 007, prior to being sent to scenario data 020. Dialect data in language database 007 is typically in the form of an alternate lexicon, but potentially also as an alternate set of pronunciation rules. These dialect data provide an additional reference of expected pronunciations. In one embodiment, the dialect is selected by a user. In an alternate embodiment, the dialect is selected by any dialect identification method known in the art. If a dialect is unknown, a tag identifying this fact is used instead, or a default null entry is used. In the case of an unknown dialect, the expectation is that resulting prosodic analysis will ultimately lead to some classification of the sample data. An example of the metadata resulting from dialect selection 002 can be seen in Table 2.

TABLE 2

| Data | Metadata Tag |
|---|---|
| Dialect = North American-Midland | <dialect>NAM</dialect> |

Next, accent selection 003 further defines the speech characteristics of the output speaker by appending the output speaker's accent to scenario data 020. Although accent is similar to dialect, a dialect selection may also be appropriate depending on the circumstances. For example, both dialect and accent data would be necessary if the synthesizer were to model a speaker whose speech has regional sounds as well as a foreign accent, i.e., the synthesizer is to model a speaker with a German accent and a "Boston" dialect. Pronunciation rules are invoked to affect the modifications and may also reflect degrees of accent, such as "strong" or "weak". The selection process is similar to that of dialect selection, though manual input is a more likely embodiment than an automated selection. The standard data output from this process includes accent rules and/or lists, which, in one embodiment, can take the form of phoneme or phoneme string replacements within a language or dialect lexicon. Where pronunciation rules are used in place of or in addition to lexica, modifications encoded in the accent data are applied to the existing rules. The data and associated metadata retrieved from language database 007 are sent to scenario Data **0*d*0 message, which will eventually be presented to text processing subsystem 100**. An example of the output accent selection metadata can be seen in Table 3.

TABLE 3

| Data | Metadata Tag |
|---|---|
| Accent = German | <accent>german</accent> |

Next, phonetic reduction 004 further refines the speech characteristics of the output speaker for scenario data 020. Phonetic reduction selects data to mimic the tendency in many people to ineffectually pronounce word sounds, such as with a mumble, in the extreme, or by dropping certain consonants in particular sound strings. This process requires the selection of a reduction scheme, stored in language database 007, which describes either phoneme replacement patterns or signal feature adjustment patterns in order to simulate de-emphasized articulation. In one embodiment of phoneme replacement, a typical example would be to provide at least one alternative phoneme string for a given input string in order to modify. These schemes may be represented as a named flat file input or as a named database entry, and may be identified via metadata as in the example, "Reduction scheme=teen speech=<reduce>teen</reduce>. A range of effect may also be appropriate, such as "strong" or "weak". For example, for all instances of the lexicon string, "plosive consonant followed by nasal consonant", delete the "plosive consonant" and leave the "nasal consonant" (e.g. "didn't it" replaced by "dint it"). In a signal feature adjustment pattern, specific feature modifications are called out, such as in the example, "for all vowels, reduce the first formant frequency by n % and the second formant frequency by n %". Phonetic reduction 004 may be used with a given language in isolation or to further modify dialect and accent rules.

Speaker database 008 contains the pertinent speaker-dependent data required to synthesize speech phrases for that speaker. These data may include, but are not limited to, any single-speaker features maps and speaker prosody models, as well as any specific physiological characteristics that may be used in speaker selection 005 process.

Speaker selection 005 assigns selects specific speaker model and database from speaker database 008 to pass to scenario data 020. This process may include automatically assigning a speaker from the database of available single-speakers models (by using search criteria or at random), manually selecting a particular speaker of interest, or any through automated processes available in the art of speaker identification. In the current embodiment, this process primarily selects the appropriate single-speaker feature map from speaker database 008, but could be leveraged by prosody handling subsystem 200 to tailor the synthetic prosody to a given speaker. Any information related to each speaker, such as sex and preferred language, dialect or accent may automatically populate related fields as necessary. An example of the metadata produced by speaker selection can be seen in Table 4.

TABLE 4

| Data | Metadata Tag |
|---|---|
| Speaker = John Doe | <speaker>John Doe</speaker> |

Next, domain/context selection 006 identifies the proper context data within domain database 009. The identification of context in a text input is critical to the best selection of follow-on prosodic patterns. In the present embodiment, a number of specific context selections will be modeled by the user. In an alternate embodiment, an automated context identification process could be employed in the system. In either case, the context for the selected text input will define input parameters for the prosody selection subsystem.

The selection of domain/context may be performed manually (through user selection) or through automated processes available in the art of context identification. This information, stored in domain database 009, is used primarily by the prosody handling subsystem 200 to tailor synthetic prosody to the given context and domain. This information may also be used to modify single-speaker feature map 301 or to further adjust the sound of the synthetic voice, such as to invoke a whisper, hoarseness, slur, or the effects of smiling on speech. Output metadata is sent to the Scenario Data [020] message, which is then distributed to the appropriate subsystems.

Key areas to be identified by domain/context selection 006 include, but are not limited to:

Domain: Typically the setting in which the synthetic "speaker" is operating, such as presenting a news broadcast, controlling aircraft, piloting an aircraft or reading a children's story.

Context: Within each domain will typically be identified germane contexts, such as "normal operations", "critical emergency", "serious", "comedy". More than one context may apply.

Role: When the role of the speaker is important to how the speech signal may need to be modified it may be called out to provide additional lexical, syntax, prosodic or articulatory control input. As an example, some languages use different word forms depending on the role or status of the speaker.

Mood: One or more moods may be assigned to the text, such as "happy", "sad" or "formal."

Genre: A genre is a common organizational pattern such as such a textbook article or catalog. A number of typical genres will fit within a domain, while many other genres would never make sense in that same domain. For example, a text and related reading style for a textbook article wouldn't sound right in a simulation of air traffic controller activities.

Tone: Multiple tones may be available to a genre or other area and can change throughout the piece. They are typically more subtle or of shorter duration, modifications of mood and are often best expressed in the adverbial form, such as, "happily", "sadly" or "conspiratorially". Often used in parody, tone shift can also express additional emphasis.

Persona: Related to role, persona can impart additional prosodic effect on speech.

TABLE 5

| Data | Metadata Tag |
|---|---|
| Domain | <domain>AirTrafficControl</domain> |
| Context | <context>EmergencyProcedure</context> |
| Role | <role>pilot</role> |
| Mood | <mood>focused</mood> |

Finally, text input 012 contains the speech phrase to be synthesized. Text input 012 pre-processing involves at least two steps to ensure standardized text data are passed to the following subsystems. First, the input text must be presented to the system. Second, the presented data must be analyzed and identified by encoding type and converted/standardized as needed. Text Input methods may include, but are not limited to: text files, text embedded in an input message or stream, and terminal input. Encoding handling will identify the character encoding used (e.g. ASCII, Unicode, etc.) and pass it to the text processing system 100. For example, "Text=Cactus 1549, hit birds, lost power to both engines" (note that "both" is italicized to imply an underlying markup to direct a word emphasis control of pitch and power).

Text Processing Subsystem [100-Series]:

FIG. 2 shows an embodiment of the next broad subsystem: text processing 100. In the present embodiment, text processing 100 is comprised of text parsing 101, text metadata 102, text segmentation 103, segment extraction 104, lexicon selection 105, breathing effects 106, non-speech effects 007, transcript compilation 108, and transcript data 109.

The first process seen is text parsing 101. In the present embodiment, this process receives text input 012 and removes any additional metadata or tags, such as italics, from text input 012 and stores the metadata or tags as text metadata 102 for use in later processing. These tags may also include text markups that direct prosody handling subsystem 200, as well as tags that control aspects of segment extraction 104. The tag-free version of text input 012 is then passed to text segmentation 103. In an alternative embodiment, text parsing 101 may also receive scenario data 020 and pass it to text segmentation 103 for use in downstream processing.

The output of tag-free text input 012 from text parsing 101 is next received by text segmentation 103. Text segmentation 103 divides text input 012 into its component words or syllables. This is often trivial for most Latin-derived languages, since whitespace usually denotes word breaks. However, this quickly becomes more difficult for some Asian languages, where there is no equivalent whitespace delimiter between words. Additionally, not all languages use the same characters to denote word breaks. A process known in the art as "Word Splitting" is often used to infer where word breaks occur in languages where word segmentation is non-trivial. There are many methods known in the art to accomplish this task. The output from text segmentation 103 is text input's constituent word segments, which is then fed to segment extraction 104 in the present embodiment.

In this embodiment, the output from text segmentation 103 is next passed to segment extraction 104. Segment extraction 104 uses lexicon database 011 and lexicon selection 105 (both described in further detail below), to produce a phonetic transliteration of now segmented text input 012. Segment extraction 103 queries a lexicon reference supplied by lexicon selection 105 system with the words/syllables supplied by the text segmentation 103 to produce a phonetic transliteration of the text input 012. In the current embodiment, segments of interest are typically phonemes or diphones. In alternative embodiments, other segment types may also be extracted if the data are available. These other segment types may include, but are not limited to, syllables, phones, morphemes and others. Extraction is typically achieved through a conventional data query and/or look-up-table process, as currently known in the art. However, in the event that desired words do not exist, the system may optionally prompt the user to provide the appropriate transliteration or even automatically attempt to provide the undefined transliteration through any process known in the art. The resulting output is the phonetic transliteration of the given text, which in the current embodiment is sent to transcript compilation 108 process. In an alternate embodiment, if other segment types are required, their data (e.g. syllables, phones) are also included as output. In yet another embodiment, a user-interactive system, such as a simulation scripting or a training narrative, could allow a user to adjust pronunciations for instances where the best automated match is not sufficient to the user's task. Segment extraction 104 passes the output phonetic transliteration to transcript compilation 108.

As mentioned above, lexicon database 011 is, in the current embodiment, a database that stores representations of all possible words in a language or domain, with each word's corresponding phoneme string, including syllable emphasis and diacritical markers phoneme modifications such as tone pattern. The lexicon database may contain different languages. It may also contain different pronunciation rules or lists that can be used to change the accent/dialect. Similarly, there may be unique rules or lists that allow for improved or reduced articulation. Lexicon database 011 may be contained in any storage medium that is convenient for processing by text processing subsystem 100. In the context of a limited speech domain, a lexicon may be supported or replaced by a pronunciation rule set designed specifically for the target dialect of the language to be synthesized. More advanced rules may also consist of classes of pronunciation guides suited to the language and character input, such as letter-to-sound rules and syllable/mora emphasis.

Lexicon selection 105, in the current embodiment, uses information from scenario data 020, such as the language, speaker, context, and associated identification information to extract the appropriate lexicon references, represented as a list or set of rules for converting words to their constituent phonemes, from the lexicon database 011. The resulting output of this process contains the lexicon list relating to the given input criteria and is passed to the segment extraction 104 process.

Text processing subsystem 100 also comprises breathing effects 106, which produces data to represent natural-breathing. Natural-sounding breathing is another important component of speech synthesis. In one embodiment, breathing data can be represented as a speaker-dependent model (found in the single-speaker feature map 301) or, in an alternative embodiment, as a set of speaker-independent breath signatures. In either case, it's important to insert the right kind of breathing based on the given scenario. In the present system, multiple breathing categories may be included. The most basic use of "inhalation" and "exhalation" provides a more natural cadence to the speech. Different types of breathing may also express emotion, tone, persona and attitude. Breathing patterns may also be further modified to affect the speech portions of the signals, such as to synthesize someone speaking while out of breath.

Signal parameters, such as type of breathing, duration and power are controlled by text input 012 and provided to the breathing effects 106 via text metadata container 102. Output breathing data, which, in the present embodiment, resembles the phoneme string transcript output of segment extraction 012 process, is presented to transcript compilation 108, where they are treated as diphones. Breathing is usually assigned to a passage of text by passage defaults, which are defined by a configuration table, or similar appropriate manner, for mapping how many words, syllables or other utterances may be synthesized before an inhalation must be inserted. Direct inputs may be used to temporarily override the default values. An example of an embodiment of passage defaults may be seen in Table 6.

TABLE 6

Passage Defaults

| Enabled | Variable | Number |
|---|---|---|
| Yes | Words between breaths | 5 |
| No | Syllables between breaths | 0 |
| No | Exertion | 20 |

TABLE 7

Direct Breathing Markup

| Input Markup | Description |
|---|---|
| <breath>breath_70/30</breath> | Breathing, with inhalation followed immediately by exhalation, mouth filter signal (70%) and nose filter signal (30%) defined |
| <breath>speak_70/30</breath> | Speaking inhalation (most commonly used) |
| <breath>stopped</breath> | Inhalation followed by stop. |
| <breath>exert_20</breath> | Level of exertion (20%) |
| <breath>labored_(type)_(level)</breath> | Specific breathing challenge and degree |
| <breath>tone_frustrated_60</breath> | Frustration expressed to greater or lesser degrees |

In the present embodiment, breathing sounds may be modeled in at least two ways. The first and most common method is to introduce labeled breathing samples to a single-speaker feature map 301, as with a phoneme or diphone. Labeled samples may include any number of breathing patterns required for a synthesis task. Degrees of each breathing type may be included to align with tone, context and other expressions. These may be normalized and backfilled to other speaker inventories, as described by processes 301 to 304. If insufficient, a breathing sample may be altered via any available pitch and power shifting techniques to better match a voice for a speaker with a different vocal tract length. Further alterations may include the stochastic alteration of power and duration input so that the same exact breathing pattern isn't repeated—repeated signals are easily perceived by the listener, which can add to the distraction of the synthesis.

The second most common method for adding different inhalation sounds to a speaker inventory is to modify a selection of mid-close, near-close and close vowels, preferably front or alveolar area vowels, such as "ee", "ih", or "eh". Once identified in the single-speaker feature map or inventory, the lowest formant data is removed from the feature set and the filter entered into the inventory as a whisper sound with the corresponding vowel sound appended label. The result is then treated as an unvoiced phoneme in the system such that a white noise or similar source is passed through the new filter to produce an inhalation-like sound. The addition of a prosodic contour controls the sounds as desired to produce context-related effects.

Text processing subsystem 100 also comprises non-speech effects 107, which is in communication with text metadata 102, and produces phonetic representations of sounds and modifications other than speech and breathing. These sounds may include background or other "human produced" effects such as acoustic reverberation (e.g. filter effects of being in a specified vehicle) inorganic sounds (e.g. a background power generator), or filter effects (e.g. telephone and radio effects). Human produced effects may include anything from the vocal tract or other portions of the anatomy (e.g. coughing, sneezing, sniffing, swallowing, throat clearing, clapping). The input may be presented through a cue for a desired effect (e.g. "cough 3 seconds") or direct markup input (e.g. <ns>cough_dur3</ns>). The resulting output is sent to the transcript compilation 108 process where, in the current embodiment, the sounds are treated as diphones, although may be treated as other phonetic representations in alternative embodiments.

In the present embodiment, most of the effects produced by non-speech effects 107 are treated like phonemes and diphones and are inserted in the input text when required by the user. Their feature modeling data come from either the "Automated Voice and Speech Labeling" technology (Patent Pending), or from manually labeled samples added to a single speaker feature database. Filter effects may be applied as an additional modification of a synthesis filter frame. The effects may also be backfilled into other model inventories.

Text processing subsystem 100 also comprises transcript compilation 108 which merges the speech, breathing, and non-speech transliteration data into a transcript message composed of phoneme segment strings. Transcript compilation 108 merges the separate transliteration data inputs coming from segment extraction 104, breathing 106, and non-speech sounds 107 processes, resulting in a time-coherent transcript string of the merged input data. This string is then stored to transcript data 109 container for later processing by prosody handling 200 and filter stitching 300 subsystems.

Prosody Handling Subsystem [200-Series]:

Next, scenario data 020, and output from text processing subsystem 100 is received by prosody handling subsystem 200. Prosody handling subsystem 200 is responsible for creating rhythm, stress and intonation data. In order to achieve a realistic sounding output, it is important to control prosodic features in a manner consistent with the context of the text being synthesized. The three main signal features associated with prosodic control, duration (rhythm control), amplitude (stress control) and pitch (intonation and, sometimes stress control) are linked to many different input variables which often depend on the given scenario. To perform this function, prosody handling subsystem 200 comprises the following: prosody selection 201, external prosody 202, advanced prosody 203, prosody sufficient 204, user prosody markup 205, and prosody data 206.

Prosody selection 201 is an automated process that uses the scenario data 020 metadata inputs, such as "domain", "context", "role" and others, to manage the different combinations of the prosody variables described above. This suggests hundreds of different control pattern models available to the user or system, each of which defines the prosodic element patterns to be applied temporally to any utterance. By selecting the variables most appropriate to the synthesis task, the resulting synthesis output will sound more natural and human-like.

In the preferred method for controlling prosody, advanced prosody 202 uses models and methods produced by an external, SRC-developed Prosody Analysis and Control technology, currently under development. This system is trained against aligned text and audio samples for a given domain and uses the input selected in the synthesis system to the automated prosody selection process. Training methods include, but are not limited to, neural networks, temporal decision trees, Hidden Markov and the Viterbi algorithm to capture contextual information and link it to signal parameter modifications. Once it is available to the system it is envisioned that most, if not all, prosody selection will occur automatically. This can be achieved by analyzing the text input, comparing it to models in the prosody analysis database, and then implementing the best control of the synthesis signal pitch, power, and signal features, such as formants.

Alternatively, external prosody 203 allows for third-party prosody modeling to be used if necessary. This is of particular importance when a more complete, internally implemented solution is not yet available for a desired language or dialect. This process simply forwards the required prosody control parameters to any available third-party tools, then parses their resulting output and associated metadata to select the best available prosodic contour for the given scenario. Possible third-party data schemes include a number of different text files or streams that represent prosodic data, such as pitch and amplitude data in the ToBI, SSML, or Mary formats. The resulting output is a standardized dataset containing the available prosody contours for the given utterance.

The present embodiment of external prosody 202 employs context-dependent Hidden Markov Models (HMM), such as that used in the open-source text to speech platform, "MARY TTS" (Schröder et al, 2008; Schröder et al, 2003). This system uses context-dependent HMMs "to predict duration and generate parameters like mel-cepstral coefficients, log F0 values, and bandpass voicing strengths using the maximum likelihood parameter generation algorithm including global variance" (Toda et al, 2007). While MARY TTS synthesizes speech from mel-ceptrum coefficients and its own mixed excitation signal, our synthesis system could leverage the MARY TTS prosody rules already built from speech corpus analysis. Further leveraging the open source parts of speech tagging, hierarchy assignment and boundary selection from Mary TTS to derive a pitch contour, our system would synthesize speech from its own F0 parameters, speed, formant parameters and signal extension parameters discussed later. This method is further supplemented in the system with the inclusion of text markup tags to introduce, increase or decrease prosodic effects, as desired by the user.

As part of the MARY TTS system, or as an independent input method, the text input labeling system, "Tones and Break Indices" (ToBI)—uses a method for transcribing intonation patterns available for several languages. Pitch contour shapes derived from patterns noted in labeled data are defined in a table for selection as part of the text input process (Huang et al 2001). The following example (Pammi, 2011) uses relative increases and decreases in pitch to adjust the pitch contour along the duration of the utterance of interest. Each row represents a contour, defined by its reference label at the start of each row (e.g. H*, L*, etc.). This output would be used to control prosodic signal contours.

Next, prosody sufficient 204 decision gate determines whether a prosody assignment or other solution is available from the external or automated processes received from advanced prosody 202 or external prosody 203. It then chooses the best prosody contour candidate to pass down the synthesis chain. To enable prosody sufficient 204 to make an appropriate decision, external prosody 203 and advanced prosody 202 systems inform prosody sufficient 204 of the availability and confidence of a any prosody contour gathered by external prosody 203 and advanced prosody 202. This information may take the form of discrete tags, such as "none", "partial" or a "complete" prosody contour, or a continuous range scale, say from [0,1]. If no prosody solution is available, the text is highlighted and the user is prompted via any appropriate user prosody markup 205 interface. In case of a "partial" solution, the system may be configured to notify the user based on some threshold, such as the prosody system's own confidence measure of a natural language label. If a complete prosody model is available, it is stored directly to prosody data 206 container.

In the instance of an incomplete prosody contour, the user may be prompted by prosody markup 205 to provide or accept a prosody contour. Methods include the manual inclusion of prosody contour data, via user interface, text markup tags or other means. This user input provides sufficient information to set, raise and lower pitch and power data and output it in the same format as the automated processes. After the user accepts the available prosody contour or provides one manually, the resulting contour is passed to prosody data 206.

Prosody data 206 unit is simply a container used to store the prosody model for subsequent processing by filter synthesis subsystem 400. These data include the complete prosody model (e.g. pitch, power, time) used for synthesis. This can be in the form of a saved digital file or a stream of information.

Filter Stitching Subsystem [300-Series]:

FIG. 4 is a block diagram of an embodiment of filter stitching subsystem 300. As shown in FIG. 4, filter stitching subsystem 300 is comprised of a single-speaker feature map 301, a diphone analysis section 302, a diphone present section 303, a multi-speaker backfill 304, a stitch analysis section 305, a quality sufficient section 306, a filter stitching section 307, and a stitched filter data section 308.

Before discussing the process flow, it is necessary to introduce single-speaker feature map 301 which contains information about a selected speaker's phonetic inventory. In the present embodiment, single-speaker feature map 301 contains a list of diphones and a corresponding list of signal features candidates, from a speaker of interest, associated with each diphone. An example of signal features that correspond with each diphone stored in single-speaker feature map are frequency, bandwidth, or amplitude. In the present embodiment, the process of building single-speaker feature map 301 requires inputting known samples from the speaker of interest and labeling them to correspond to diphones. In the present embodiment, single-speaker feature 301 map does not require any synthesis system inputs, rather it is itself an input to the synthesis system. Currently, the single-speaker feature map is implemented as a relational database. The outputs from the single-speaker feature map are in the form of query results, and contain information about the selected speaker's diphone inventory. An example query is: select * from SingleSpeakerFeatureMap where phoneme1='9' and phoneme2='&'.

In the present embodiment, the first process of filter stitching subsystem 300, diphone analysis 302, receives transcript data 109 and first groups the phonemes contained in transcript data into diphones. Each diphone is then checked against the single-speaker feature map for at least one corresponding signal feature. Diphone analysis 302 will output a list of identified diphones and candidate signal features from the single-speaker feature map. If no candidates exist, the returned list will be empty. For example, diphone present 302 will receive adjacent phonemes '9', '&' from transcript data 109. These adjacent phonemes are joined to create the diphone '9 &'. If the corresponding signal feature candidate for this diphone exists in the single-speaker feature map, the corresponding output list contains the unique ID numbers of the matching entries (such as {100, 101, 222}). If the corresponding signal feature candidate does not exist in the single-speaker feature map, the corresponding output list will be empty (e.g. { }). In the current embodiment, SQL queries are used to find matching signal feature candidates within the single-speaker feature map.

Multi-speaker backfill 304 supplements single-speaker feature map 301 by supplying at least one signal feature candidates from other speakers when the single-speaker map lacks a feature candidate for a particular diphone of sufficient quality (determined by quality sufficient 306 discussed below), or the feature candidate is nonexistent. In the current embodiment, multi-speaker backfill 304 is a relational database that contains a list of diphones and a corresponding list of signal features, from a multiplicity of speakers, associated with each diphone. Multi-speaker backfill 304 also modifies any signal feature that is supplementing single-speaker map 301 to match how it would appear in the single-speaker-feature map if it were there originally.

The inputs to multi-speaker backfill 304 process include: (1) the diphone to be backfilled; (2) selected speaker; and (3) selected language/dialect. The outputs from the multi-speaker backfill process are new entries that are injected into the single-speaker feature map. These entries correspond to the missing diphones, which will then allow the diphone analysis process to provide non-empty lists for those diphones.

In one embodiment, the diphone of interest is scanned for, for each speaker within the multi-speaker database. Additionally, the diphone immediately preceding the diphone of interest is scanned for. The various combinations of preceding and current diphones are tested for stitching quality (as per processing boxes 305 and 306). When a predetermined number of sufficiently "good" candidates are found (or all candidates are tested), searching stops. Given a sufficiently large multi-speaker database, there is a high probability that good candidates will be found.

Several alternative embodiments have been identified to modify a signal feature candidate to match how it would appear in a single-speaker feature map. In one embodiment, a mapping is constructed from the speaker in the multi-speaker database (the multi-speaker speaker) to the speaker to be synthesized (the single-speaker speaker). For instance, using a common phrase (e.g. "she had your dark suit in greasy wash water all year"), an input/output mapping is built for the phrase, where the input is each diphone from the multi-speaker speaker to the corresponding diphone from the single-speaker speaker. A system is trained on the input/output mapping capable of generalization (e.g., a neural network) and the candidate from the above search process is presented to the mapping to generate the single-speaker version of the candidate. Finally, the single-speaker version is injected into single-speaker map 301.

In an alternative embodiment, self-organizing feature map (SOM) is constructed and trained on the feature vectors of the found candidates. The transition portion of each SOM exemplar pattern is easily identified (this identification has already been done for each candidate and carries through easily). Each transition portion describes how the formant frequencies, bandwidths and amplitudes change when moving from steady-state phoneme to steady-state phoneme [the phonemes that make up the diphone]. These descriptions are then applied to corresponding examples phonemes from the single-speaker inventory, effectively constructing the diphone of interest from easily identified (this identification has already been done for each candidate and carries through easily). Each transition portion describes how the formant frequencies, bandwidths and amplitudes change when moving from steady-state phoneme to steady-state phoneme [the phonemes that make up the diphone]. These descriptions are then applied to corresponding examples phonemes from the single-speaker inventory, effectively constructing the diphone of interest from existing steady-state parts. The constructed diphone is injected into the single-speaker feature map.

Stitch analysis 305 process analyses the cost associated with joining adjacent signal feature candidates. Joining candidates will often result in mismatched signal features, such as frequency, amplitude and bandwidth, between the diphones. For example, the frequency at the end of a particular diphone may be higher or lower than the frequency at the beginning of the following diphone. These mismatched signal features are known as feature join artifacts. If the feature join artifacts are too large, in other words the difference between the signal features of adjacent diphones is too great, there will be a sharp reduction in quality of the synthesized voice. Stitch Analysis 305 analyzes the magnitude of the feature join artifacts and returns an estimate of the cost of joining each adjacent candidate pair. Stitch analysis 305 performs this estimate across all diphones in the phrase to be synthesized and thus can minimize "stitching cost" globally. Examples of good and bad stitching selections are shown in FIGS. 6*a* (the overlapping regions of frequency, bandwidth, and amplitude show a high degree of correlation—this results in stitched audio that "flows" well) and 6*b* (the overlapping regions of frequency, bandwidth, and amplitude show a much lower degree of correlation—this results in stitched audio that fails to "flow".) In the current embodiment, stitch analysis 305 determines the stitching cost between all adjacent pairs of diphones. These costs are used to build a cost graph which is then fed to a graph analysis algorithm which computes the lowest cost through the graph. Any cost minimization algorithm from the art may be employed.

Next, quality sufficient 306 is a decision point process that determines whether or not the cost of stitching a given pair of signal feature candidates is too high to ensure high quality speech. If the cost of stitching adjacent signal feature candidates is too high, the multi-speaker backfill process is invoked to populate the single-speaker map with additional diphone candidates. The additional candidates will reduce the probability that stitching costs between candidates remain high. If the cost is deemed low enough, filter stitching 307 is invoked. In the current embodiment, the input to quality sufficient 306 is the ordered list of selected diphones as well as the cost associated with each stitch point.

Filter stitching 307 is a process that "stitches" together adjacent candidates in order to ensure a smooth transition from one diphone to the next. This smoothing is applied to the formant features of the diphones, such as formant frequencies, bandwidths, and amplitudes. As a note, pitch and power are part of the stitching process since this is the purview of prosody handling subsystem 200. In the current embodiment, the input to filter stitching 307 is the ordered list of selected candidates as well as the cost associated with each stitch point. For a given pair of adjacent candidates, filter stitching 307 first identifies right-hand steady-state portion of the first candidate within the pair and then identifies the left-hand steady-state portion of the second candidate within the pair. The identified steady-state regions of both diphones are then "stitched." As the stitching process moves across the regions, the resulting features will initially look like the features from the left-hand candidate, but by the end of the stitching process will look like the features from the right-hand candidate. In one embodiment, this transition can be accomplished through a simple weighted average, where the weights change over time.

Finally, stitched filter data 308 unit is simply a container used to store the results of filter stitching 307. The output from this unit is the same as that of filter stitching 307: an ordered list of filter entries amenable to filter enhancement/synthesis.

Filter Synthesis Subsystem (400-Series):

FIG. 5 is a block diagram of an embodiment of Filter Synthesis Subsystem 400. As shown in FIG. 5, the embodiment of filter synthesis subsystem 400 is comprised of prosody alignment 401, filter enhancement 402, synthesis option selection 403, filter synthesis 404, and synthesized speech 405.

In the present embodiment, prosody alignment process 401 ensures that the independently obtained prosody contour and filter data are aligned with each other which respect to time. Because prosody handling 200 and filter stitching 300 run concurrently, there is no guarantee that the results of each will be coherent with respect to time.

Next, prosody alignment 401 receives the prosody contour from prosody data 206 and filter data contained in stitched filter data 308 and aligns the two data units with respect to time. The resulting output is an aligned synthesis message, ready for filter enhancement 403 or filter synthesis 404.

Filter enhancement 402, next analyzes the existing spectral content within each filter for frequency-bandwidth gaps, which is often a byproduct of compressed source audio signals or reduced speaker feature map data. In the case of underrepresented feature data, there may be large frequency jumps between two adjacent features. As a result, filter enhancement system 402 will programmatically attempt to fill those gaps with additional spectral content in order to improve the quality of the speech output. This gap-filling procedure may occur by any means known in the art.

In the present embodiment, synthesis option selection 403 allows the control of a number of parameters, such as the playback speed of the audio or applying different audio, that are useful from simulating unique speech scenarios. In one embodiment these parameters may be set automatically according to the scenario data. In an alternative embodiment, these parameters may be set by a user in order to obtain a desired output.

Next, filter synthesis 404 process uses the filter spectrum data (frequency, amplitude, bandwidth values) to create synthetic audio output. This is done by synthesizing the voiced and unvoiced data separately, then combining them for the final output. The voiced data is generated by using a numerically controlled oscillator to generate the voiced harmonics (all integer multiples of the fundamental pitch frequency). The amplitudes of these harmonics are dictated by the spectral content data—the harmonics are effectively filtered by the spectral data. Similarly, the unvoiced data is generated by filtering a white noise or similar signal through each frame of the spectral content. This process is akin to traditional digital filtering; however, in this process, the filter specifications are constantly changing based on the spectral data frames.

Finally, in the current embodiment, synthesized speech 405 is output in form of any digital audio container known in the art. Possible output formats include digital audio files such as mp3s, digital audio streams, etc.

As will be appreciated by one skilled in the art, aspects of the present invention may be embodied as a system, method or computer program product. Accordingly, aspects of the present invention may take the form of an entirely hardware embodiment, an entirely software embodiment or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction performance system, apparatus, or device.

The program code may perform entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Although the present invention has been described in connection with a preferred embodiment, it should be understood that modifications, alterations, and additions can be made to the invention without departing the from the scope of the invention as defined by the claims.

What is claimed is:

1. A method of synthesizing speech from text, comprising the steps of:

receiving text from which speech will be synthesized;

selecting, based on the received text, one or more scenario parameters, wherein the one or more scenario parameters are selected from the group consisting of language, dialect, accent, phonetic reduction, domain, context, and speaker number;

identifying text metadata within the received text, wherein the text metadata comprises elements other than words within the text;

parsing the received text, other than the identified text metadata, into a plurality of corresponding phonetic components;

merging said plurality of phonetic components with breathing and non-speech effects to produce a transcript of phoneme segment strings corresponding to the received text;

producing prosody contour data from said one or more selected scenario parameters and said transcript of phoneme segment strings;

producing stitched filter data from said one or more selected scenario parameters and said transcript of phoneme segment strings;

synthesizing speech from said stitched filter data and said prosody contour data; and outputting said synthesized speech from a playback device.

2. The method according to claim 1, wherein the one or more scenario parameters are selected by a user.

3. The method according to claim 1, wherein a user provides the prosody contour.

4. The method according to claim 1, wherein producing said stitched filter data comprises:

receiving said text parsed into corresponding phonetic components;

matching each corresponding phonetic component with a corresponding signal feature candidate;

identifying within the corresponding signal feature candidates each pair of adjacent signal feature candidates;

modifying the formant features of each phonetic component within the pair of adjacent signal feature candidates such the first candidate within the pair transitions smoothly to the second phonetic candidate within the pair.

5. A method for synthesizing speech from text, comprising the steps of:

providing a computer having a first database and a second database stored in the memory thereof and in which data is stored, said data in said first database representing a set of signal feature candidates representative of a single speaker, and said data in said second database representing a second set of signal feature candidates representative of multiple speakers;

receiving text from which speech will be synthesized;

selecting, based on the received text, one or more scenario parameters, wherein the one or more scenario parameters are selected from the group consisting of language, dialect, accent, phonetic reduction, domain, context, and speaker number;

identifying text metadata within the received text, wherein the text metadata comprises elements other than words within the text;

parsing the received text, other than the identified text metadata, into a plurality of target phonetic components;

analyzing said single speaker signal feature candidates from said first database to determine whether a corresponding single speaker signal feature candidate exists for each target phonetic component;

retrieving from said second database a replacement signal feature candidate from said second set of signal feature candidates for any target phonetic component that does not have a corresponding single speaker signal feature candidate;

synthesizing speech from at least one of said corresponding single signal feature candidates and said replacement signal feature candidates, the speech comprising prosody contour data and stitched filter data from said one or more selected scenario parameters.

6. The method according to claim 5, further comprising the step of:

modifying said replacement signal feature candidates such that the synthesized speech from the replacement signal feature candidates resembles the synthesized speech of the single speaker signal feature candidates.

7. The method according to claim 6, wherein modifying comprises:

constructing a map of said single speaker signal feature candidates and corresponding signal feature candidates from said second set of signal feature candidates;

training a system on said map capable of generalizing difference between said single speaker signal feature candidates and corresponding signal feature candidates from said second stored set of signal feature candidates;

modifying said replacement phonetic component according to generalized difference represented in said system.

8. The method according to claim 5, wherein said single speaker signal feature candidates and said replacement components are signal feature candidates representing diphones, each candidate from said single speaker signal feature candidates and said replacement components having a first steady-state portion, a transition portion, and a second steady-state portion.

9. The method according to claim 8, wherein modifying comprises:

identifying said transition portion of said replacement diphones and said single speaker candidate;

training a system on said transition portion, capable of generalizing features of said transition portion;

generating a new transition portion according said system;

replacing said transition portion of said first steady-portion with said new transition portion.

10. A method for synthesizing speech from text, comprising the steps of:

providing a computer having a first database and a second database stored in the memory thereof and in which data is stored, said data in said first database representing a set of signal feature candidates representative of a single speaker, and said data in said second database representing a second set of signal feature candidates;

receiving text from which speech will be synthesized;

selecting, based on the received text, one or more scenario parameters, wherein the one or more scenario parameters are selected from the group consisting of language, dialect, accent, phonetic reduction, domain, context, and speaker number;

identifying text metadata within the received text, wherein the text metadata comprises elements other than words within the text;

parsing the received text, other than the identified text metadata, into a plurality of target phonetic components;

analyzing said single speaker signal feature candidates from said first database to determine whether a corresponding single speaker signal feature candidate of sufficient quality exists for each target phonetic component;

retrieving from said second database a replacement signal feature candidate from said second set of signal feature candidates for any target phonetic component that does not have a corresponding single speaker signal feature candidate of sufficient quality; and synthesizing speech from at least one of the corresponding single speaker signal feature candidates and the replacement signal feature candidates, the speech comprising prosody contour data and stitched filter data from said one or more selected scenario parameters.

11. The method according to claim 10, wherein sufficient quality is determined by:

receiving said single speaker signal feature candidates;

identifying within the corresponding signal feature candidates each pair of adjacent signal feature candidates;

measuring a cost of joining each said pair of adjacent signal feature candidates; and determining whether said cost is too high.

12. The method according to claim 10, further comprising the step of:

modifying said replacement signal feature candidates such that the resulting synthesized speech from the replacement signal feature candidates resembles the resulting synthesized speech of the single speaker signal feature candidates.

13. The method according to claim 12, wherein modifying further comprises:

constructing a map of said single speaker signal feature candidates and corresponding signal feature candidates from said second set of signal feature candidates;

training a system on said map capable of generalizing difference between said single speaker signal feature candidates and corresponding signal feature candidates from said second s set of signal feature candidates;

modifying said replacement signal feature candidate according to generalized difference represented in said system.

14. The method according to claim 12, wherein said single speaker signal feature candidates and said replacement components are signal feature candidates representing diphones; each candidate from said single speaker phonetic components and said replacement components having a first steady-state portion, a transition portion, and a second steady-state portion.

15. The method according to claim 14, wherein modifying further comprises:

identifying said transition portion of said replacement diphones and said single speaker feature candidates;

training a system on said transition portion, capable of generalizing features of said transition portion;

generating a new transition portion according said system;

replacing said transition portion of said first steady-portion with said new transition portion.

16. A non-transitory computer-readable storage medium containing program code comprising:

program code for receiving text from which speech with be synthesized;

program code for selecting, based on the received text, one or more scenario parameters;

program code for identifying text metadata within the received text, wherein the text metadata comprises elements other than words within the text;

program code for parsing the received text, other than the identified text metadata, into a plurality of corresponding phonetic components;

program code for merging said plurality of phonetic components with breathing and non-speech effects to produce a transcript of phoneme segment strings corresponding to the received text;

program code for producing prosody contour data from said one or more selected scenario parameters and said transcript of phoneme segment strings;

program code for producing stitched filter data from said one or more selected scenario parameters and said transcript of phoneme segment strings;

program code for synthesizing speech from said stitched filter data and said prosody contour data;

program code for outputting said synthesized speech from a playback device.

17. The storage medium according to claim 16, wherein the one or more scenario parameters are selected from the group consisting of language, dialect, accent, phonetic reduction, domain, context, and a single speaker.

18. The storage medium according to claim 16, wherein the one or more scenario parameters are selected by a user.

19. The storage medium according to claim 16, wherein the user provides the prosody contour.

20. The storage medium according to claim 16, wherein producing said stitched filter data further comprises:

program code for receiving said text parsed into corresponding phonetic components;

program code for matching each phonetic component with a corresponding signal feature candidate;

program code for identifying within the corresponding signal feature candidates each pair of adjacent signal feature candidates;

program code for modifying the formant features of each signal feature candidate within the pair of adjacent signal feature candidates such the first phonetic component within the pair transitions smoothly to the second phonetic component within the pair.

21. A non-transitory computer-readable storage medium containing program code, comprising:

program code for receiving text from which speech will be synthesized;

program code for selecting, based on the received text, one or more scenario parameters, wherein the one or more scenario parameters are selected from the group consisting of language, dialect, accent, phonetic reduction, domain, context, and speaker number;

program code for identifying text metadata within the received text, wherein the text metadata comprises elements other than words within the text;

program code for parsing the received text, other than the identified text metadata, into a plurality of target phonetic components;

program code for analyzing a single speaker's signal feature candidates, said single speaker's signal feature candidates stored in a database, to determine whether a corresponding single speaker signal feature candidate exists for each said target phonetic component;

program code for retrieving from a second set of signal feature candidates representative of multiple speakers' signal feature candidates, said second set of signal feature candidates stored in database, a replacement signal feature candidate for any target phonetic component that does not have a corresponding single speaker signal feature candidate;

program code for synthesizing speech from at least one of said corresponding single speaker signal feature candidates and said replacement signal feature candidates, the speech comprising prosody contour data and stitched filter data from said one or more selected scenario parameters.

22. The storage medium according to claim 21, further comprising program code for modifying said replacement signal feature candidates such that the synthesized speech from the replacement signal feature candidates resembles the synthesized speech of the single speaker signal feature candidates.

23. The storage medium according to claim 22, wherein said program code for modifying comprises:

program code for constructing a map of said single speaker signal feature candidates and corresponding signal feature candidates from said second set of signal feature candidates;

program code for training a system on said map capable of generalizing difference between said single speaker signal feature candidates and corresponding signal feature candidates from said second stored set of signal feature candidates;

program code for modifying said replacement signal feature candidate according to generalized difference represented in said system.

24. The storage medium according to claim 21, wherein said single speaker signal feature candidates and said replacement components are signal feature candidate representing diphones, each candidate from said single speaker signal feature candidates and said replacement components having a first steady-state portion, a transition portion, and a second steady-state portion.

25. The storage medium according to claim 24, wherein program code for modifying comprises:

program code for identifying said transition portion of said replacement candidates and said single speaker candidate;

program code for training a system on said transition portion, capable of generalizing features of said transition portion;

program code for generating a new transition portion according said system;

program code for replacing said transition portion of said first steady-portion with said new transition portion.

26. A non-transitory computer-readable storage medium containing program code, comprising:

program code for receiving text from which speech will be synthesized;

program code for selecting, based on the received text, one or more scenario parameters, wherein the one or more scenario parameters are selected from the group consisting of language, dialect, accent, phonetic reduction, domain, context, and speaker number;

program code for identifying text metadata within the received text, wherein the text metadata comprises elements other than words within the text;

program code for parsing the received text, other than the identified text metadata, into a plurality of target phonetic components;

program code for analyzing a single speaker's signal feature candidates, said single speaker's signal feature candidates stored in a database, to determine whether a corresponding single speaker signal feature candidate of sufficient quality exists for each said target phonetic component;

program code for retrieving from a second set of signal feature candidates, said second set of signal feature candidates stored in database, a replacement signal feature candidate for any target phonetic component that does not have a corresponding single speaker signal feature candidate of sufficient quality;

program code for synthesizing speech from at least one of said corresponding single speaker signal feature candidates and said replacement signal feature candidates, the speech comprising prosody contour data and stitched filter data from said one or more selected scenario parameters.

27. The storage medium according to claim 26, wherein sufficient quality is determined by program code comprising:

program code for receiving said single speaker signal feature candidates;

program code for identifying within the corresponding signal feature candidates each pair of adjacent signal feature candidates;

program code for measuring a cost of joining each said pair of adjacent signal feature candidates; and program code for determining whether said cost is too high.

28. The storage medium according to claim 26, further comprising program code for modifying said replacement signal feature candidates such that the synthesized speech from the replacement signal feature candidates resembles the synthesized speech of the single speaker signal feature candidates.

29. The storage medium according to claim 28, wherein program code for modifying further comprises:

program code for constructing a map of said single speaker signal feature candidates and corresponding signal feature candidates from said second set of signal feature candidates;

program code for training a system on said map capable of generalizing difference between said single speaker signal feature candidates and corresponding signal feature candidates from said second s set of signal feature candidates;

program code for modifying said replacement signal feature candidate according to generalized difference represented in said system.

30. The storage medium according to claim 28, wherein said single speaker signal feature candidates and said replacement components are diphones; each diphone from said single speaker signal feature candidates and said replacement components having a first steady-state portion, a transition portion, and a second steady-state portion.

31. The storage medium according to claim 30, wherein program code for modifying further comprises:

program code for identifying said transition portion of said replacement diphones and said single speaker feature candidates;

program code for training a system on said transition portion, capable of generalizing features of said transition portion;

program code for generating a new transition portion according said system;

program code for replacing said transition portion of said first steady-portion with said new transition portion.

* * * * *